US006715439B1

(12) United States Patent
Ortelli

(10) Patent No.: US 6,715,439 B1
(45) Date of Patent: Apr. 6, 2004

(54) MECHANISM FOR THE VERTICAL TRANSLATION OF TUBULAR STRUCTURES FOR UNDERWATER VESSELS

(76) Inventor: Aurelio Ortelli, Via Saragozza, 115, 40135 Bologna (IT)

( * ) Notice: Subject to any disclaimer, the term of this patent is extended or adjusted under 35 U.S.C. 154(b) by 0 days.

(21) Appl. No.: 10/355,328

(22) Filed: Jan. 31, 2003

(51) Int. Cl.[7] ..... B63G 8/04
(52) U.S. Cl. ..... 114/339
(58) Field of Search ..... 114/339, 340, 114/312, 313

(56) References Cited

U.S. PATENT DOCUMENTS 4,175,311 A 11/1979 Bunyan
5,634,424 A * 6/1997 Ortelli ..... 114/339

FOREIGN PATENT DOCUMENTS

| | | |
|---|---|---|
| DE | 90 10 980 | 12/1990 |
| DE | 44 18 111 | 12/1994 |
| EP | 0 711 702 | 5/1996 |
| EP | 11 77 974 A2 * | 2/2002 |
| GB | 2 101 257 | 1/1983 |

OTHER PUBLICATIONS

European Search Reporting corresponding to International Application No. EP 01 83 0520.
Article/Brochure titled *Adhesive Bonding*, 4575 Assembly Engineering, 33 (1990) Jul. No. 7, Carol Stream, IL, US.

* cited by examiner

*Primary Examiner*—Stephen Avila
(74) *Attorney, Agent, or Firm*—Fay, Sharpe, Fagan, Minnich & McKee, LLP

(57) ABSTRACT

Mechanism for the vertical translation of tubular structures for underwater vessels of the type constituted by a rectilinear guide (2) with closed section that is vertically fastened to the sail (3) of the underwater vessel, by a barrel (4) translating vertically inside said guide (2) and bearing at its upper end a sensor and by a device for the vertical actuation of said barrel (4), said guide (2) being constituted by a flattened upright (7) which along its flanks has, integral therewith, two sliding ways opened towards each other and it has its edges secured by a rugged and simple stiffening element (13) constituted by a "U" shaped structure and that said barrel (4) in proximity to the lower end is provided with two supports **(14*a*), (14*b*) bearing shoes (16) for sliding along said ways, said barrel (4) being secured to said supports (14*a*), (14*b*)** by the casting of an appropriate hardening plastic material.

10 Claims, 3 Drawing Sheets

MECHANISM FOR THE VERTICAL TRANSLATION OF TUBULAR STRUCTURES FOR UNDERWATER VESSELS

BACKGROUND OF THE INVENTION

The present invention relates to a mechanism for the vertical translation of tubular structures for underwater vessels, in particular for submarines.

On submarines the problem exists of bringing out of the water, when the submarine is at periscope depth, a certain number of passive or active sensors, such as radar antennas, radio antennas, optronic heads etc.: these sensors are housed inside the sail of the submarine and, when required, they are translated vertically by appropriate raising devices (hydraulic or electromechanical) until they are made to emerge out of the free surface of the water above the sail.

These vertical translation mechanisms are required to exhibit considerable rigidity and strength to withstand the effects of hydrodynamic resistance, to be easily installed and removed (for maintenance), to have simplicity of construction, such as to make them reliable, and lastly to have an acceptable cost.

Raising systems existing on the market are not able to meet all these requirements simultaneously: for instance, a type of raising is known which is based on the use of a rectilinear guide with rectangular section which is fastened vertically in the sail of the submarine, of a barrel translating vertically inside the guide and bearing the sensor at its upper end and of a device for the vertical actuation of the barrel, but the functional and constructive realisation of these elements exhibits considerable complexity and hence leads to considerable costs.

A known guidance solution is obtained with a rectangular structure divided in two halves, which bears four path ways in correspondence with the corners of the rectangle; aside from the need to machine four path ways, there is the need of a precise flange coupling between the two halves and this entails noticeably higher costs.

In regard to the barrel, in a known solution it is made of steel with two steel structures welded to the base at two different levels and each provided with four arms to bring the shoes in correspondence with the four corners of the guide.

Aside from the complexity of this structure, with mutually welded elements, the precision machining of the seats of the hoes, which must necessarily be performed after welding, constitutes a costly operation; since this is a piece of considerable dimensions (5 or 6 meters long) and heavy weight, the mechanical machining must necessarily be performed on a large boring machine with long positioning and machining times.

SUMMARY OF THE INVENTION

The invention is aimed at obtaining a mechanism for the vertical translation of tubular structures for underwater vessels which, whilst safeguarding all technical and functional requirements, is simple and hence has reduced cost.

This task and these aims are achieved by the present mechanism for the vertical translation of tubular structures for underwater vessels of the type constituted by a rectilinear guide with closed section which is fastened vertically in the tower of the underwater vessel, by a barrel translating vertically inside said guide which bears at its upper end a sensor and by a device for the vertical actuation of said barrel, characterised in that said guide is constituted by a flattened upright which along the flanks has, integral therewith, two sliding guides open towards each other and has its edges fastened by a rugged and simple stiffening element constituted by a "U" shaped structure and that said barrel in proximity to the lower end is provided with two supports bearing shoes for sliding along said ways, said barrel being secured to said supports by the casting of an appropriate hardening plastic material.

In regard to the raising device, solutions already known in the art may be adopted.

BRIEF DESCRIPTION OF THE DRAWINGS

Additional features shall become more readily apparent from the detailed description of a preferred, but not exclusive, embodiment of a mechanism for the vertical translation of tubular structures for underwater vessels according to the invention, illustrated purely by way of non limiting example in the accompanying drawing tables, in which.

DESCRIPTION OF THE PREFERRED EMBODIMENTS

Figure 2:
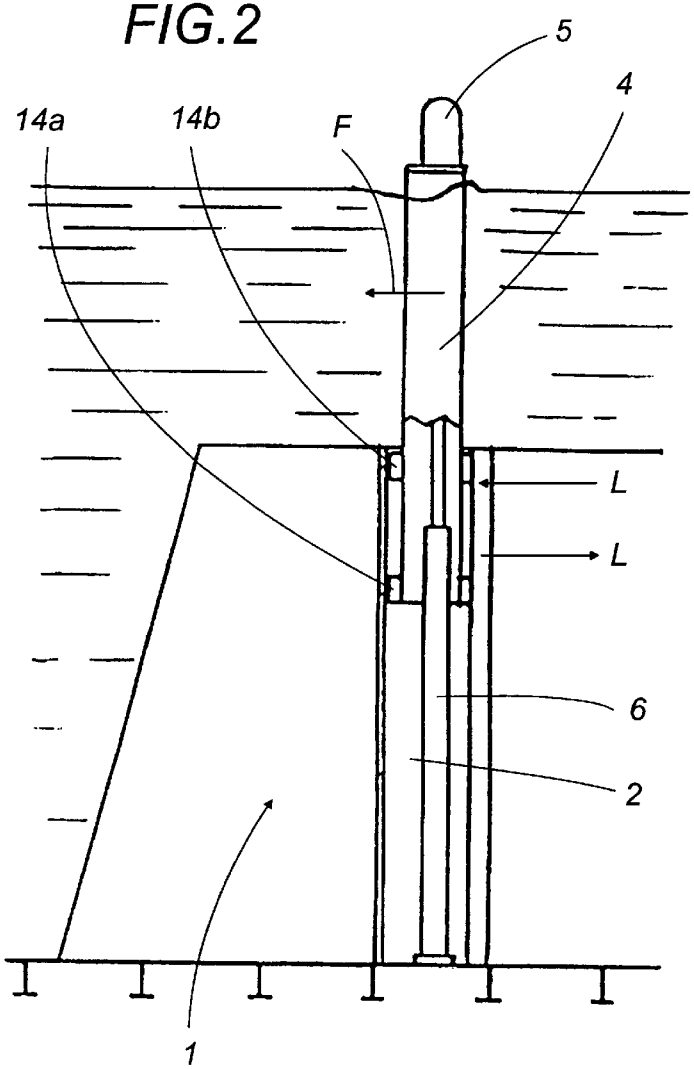
FIG. 1 and FIG. 2 are schematic lateral section views of a submarine sail, provided with a mechanism for the vertical translation of tubular structures for underwater vessels according to the invention, respectively in retracted and raised configuration.
Figure 1:
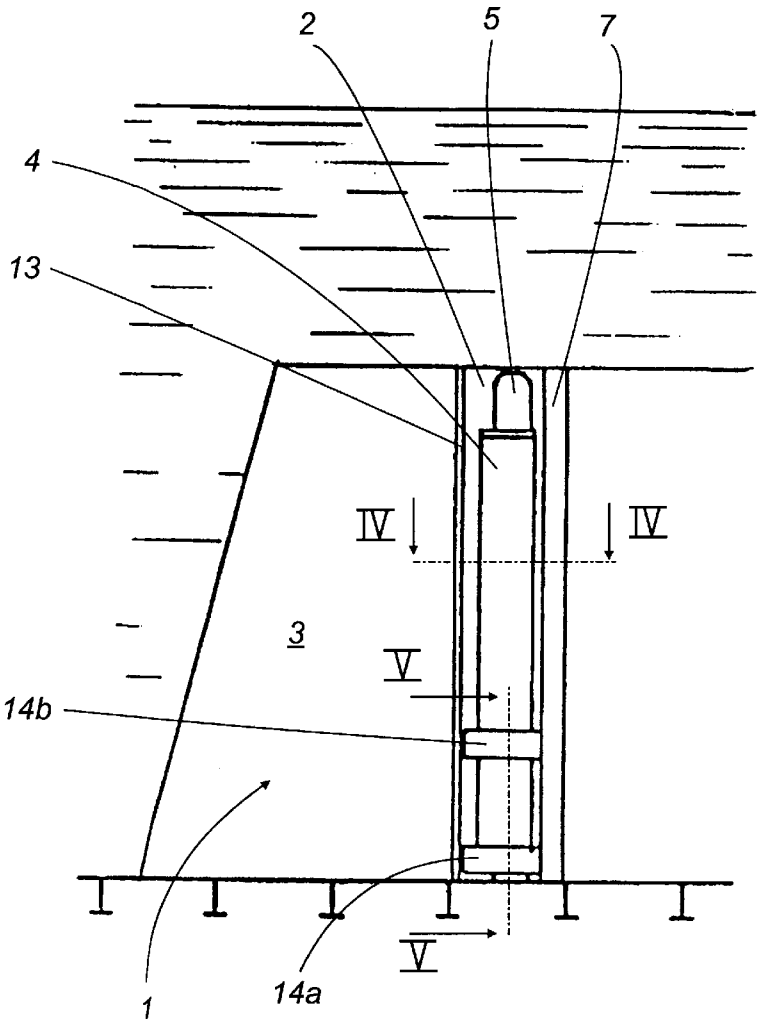

With particular reference to the figures, the number 1 globally indicates the mechanism for the vertical translation of tubular structures for underwater means according to the invention.

The device 1 is constituted by a rectilinear guide 2 with closed vertical section which is fastened vertically in the sail 3 of the submarine, by a barrel 4 translating vertically inside the guide 2 and bearing at its upper end a sensor 5 and a device 6 for the vertical actuation of the barrel which can be of any kind but in the case shown herein is a hydraulic cylinder.

The guide 2 is constituted by a flattened upright 7 constituted by two section bars 8*a*, 8*b*, mutually specular, advantageously obtained by extrusion, which along an edge exhibit portions 9 with "U" shaped section able to define sliding ways for the shoes of the barrel and which are joined together by means of a rugged welded structure 10.

The sliding ways defined in the portions 9 are opened towards each other: on the outer surface of the section bars 8 can be fastened the edges 13 of a rugged stiffening element 13 with substantially "U" shaped section: a box assembly of great rigidity is thereby obtained.

The barrel 4 has a section whose profile is advantageously hydrodynamic and, in proximity to the lower end, is provided with two supports 14*a* and 14*b* each fitted with a pair of lateral appendage 15 bearing shoes 16 made of appropriate anti friction material able to slide along the ways 9.

The barrel 4 is rigidly fastened to the supports 14 by means of hardening plastic material 17 cast between the barrel and respective contoured openings 18 present in the support, whose shape is complementary to that of the barrel.

Figure 4:
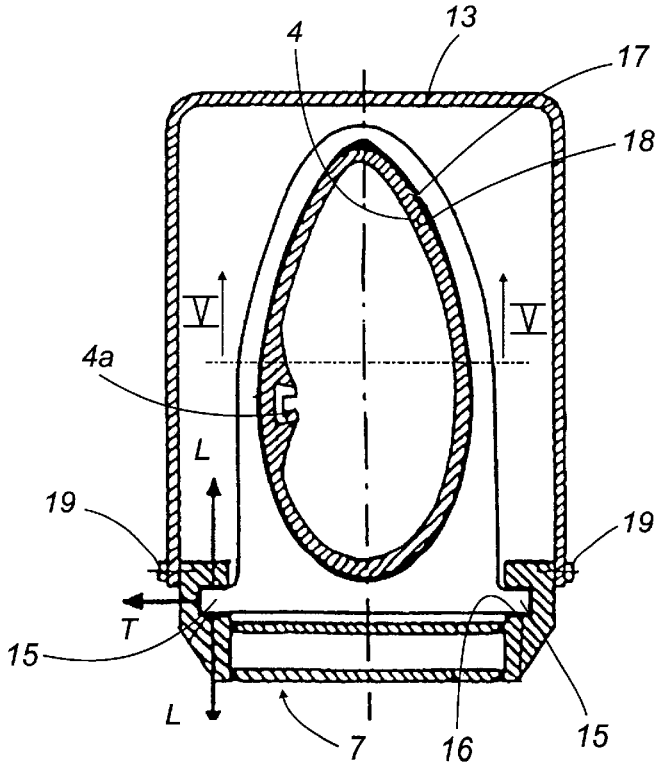
FIG. 4 is a plan view, sectioned according to the trace plane IV—IV of FIG. 1 and enlarged, of the guide and of the barrel according to the invention in mounted condition.

The flattened upright 7, in itself, exhibits considerable flexion rigidity in the horizontal plane such as to allow it adequately to support the flexing moments generated by the local longitudinal L and transverse T forces which are transmitted thereto by the shoes of the barrel (consequent to the hydrodynamic resistance F of the barrel that moves in water) (FIGS. 2 and 4).

This structure is absolutely not capable, by itself, of withstanding, given its reduced thickness and its length, to the flexing moment in the longitudinal vertical plane; in other words this structure has adequate rigidity in the horizontal plane, but absolutely insufficient in the longitudinal vertical plane.

Figure 3:
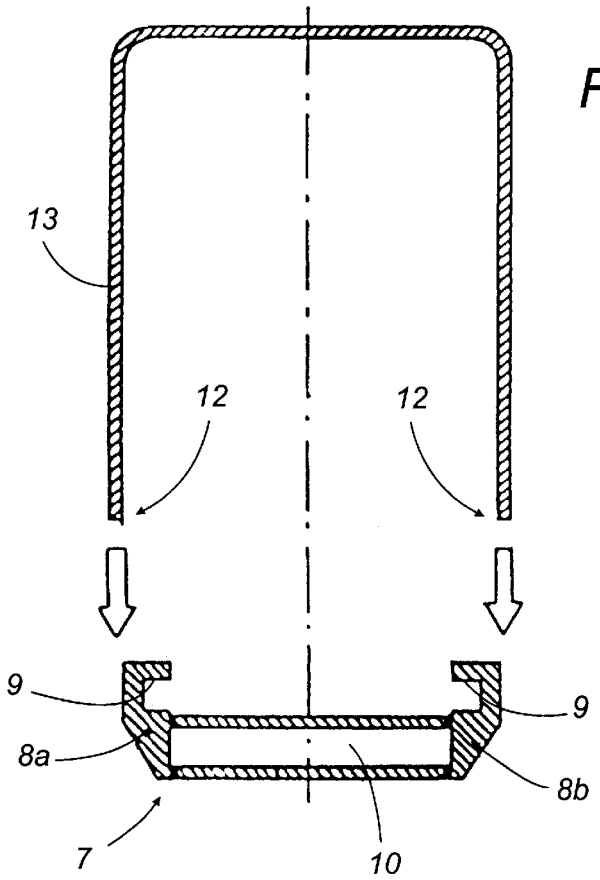
FIG. 3 is a sectioned plan view of the guide of the mechanism according to the invention in pre-mounted condition.
Figure 3A:
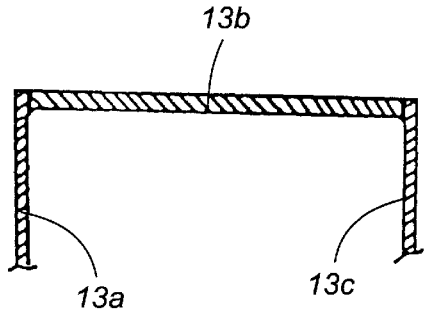
FIG. 3*a* is a detail of an alternative solution to the one shown in FIG. 3.

The necessary rigidity in this plane is provided by the element 13 which is coupled to the upright 7; the element 13 is substantially constituted by a plate of appropriate thickness and bent to a "U" shape, see FIG. 3, or by three metal plates 13*a*, 13*b*, 13*c* arranged in a "U" shape and welded to each other, and the intermediate plate, 13*b*, to increase the moment of inertia, may have greater thickness.

Said plates may be provided with lightening holes and transverse stiffening ribs.

The element 13 may be made of fibreglass-reinforced resin or other composite material.

Figure 4A:
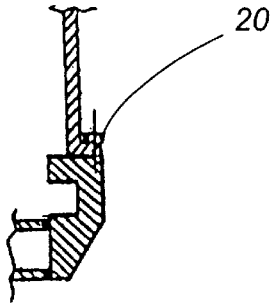
FIG. 4*a* is a detail of an alternative solution to the one shown in FIG. 4.
Figure 4B:
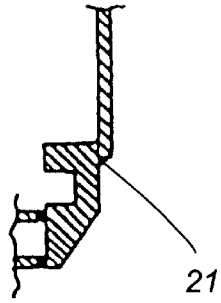
FIG. 4*b* is a detail of an additional alternative solution to those shown in FIG. 4.

The coupling between the two elements 13 and 7 can be obtained either with fastening screws 19 (see FIG. 4) or 20 (see FIG. 4*a*), or by simple welding 21 of the two elements to each other (see FIG. 4*b*): the addition of the element 13 enormously increases the moment of inertia of the section of the guide in the direction of flexion in the longitudinal vertical plane; therefore, it is able to withstand the considerable flexing moments due to hydrodynamic force F.

The simplification of the construction of the guide according to the invention consists of the fact that the sole precision machining work required is bring to measure only the two sliding ways 9; this operation, which is performed before the coupling to the stiffening element 13, is easy and relatively inexpensive since it is possible to place the upright on the machine tool (miller-planer or boring machine) only once, with the consequent ease in meeting required tolerances and surface finishes.

On the other hand, the structural element 13 ("U" shaped plate) requires no particular precision in its geometric configuration and need not be subjected to precision machining work, and consequently its cost is extremely reduced.

Figure 5:
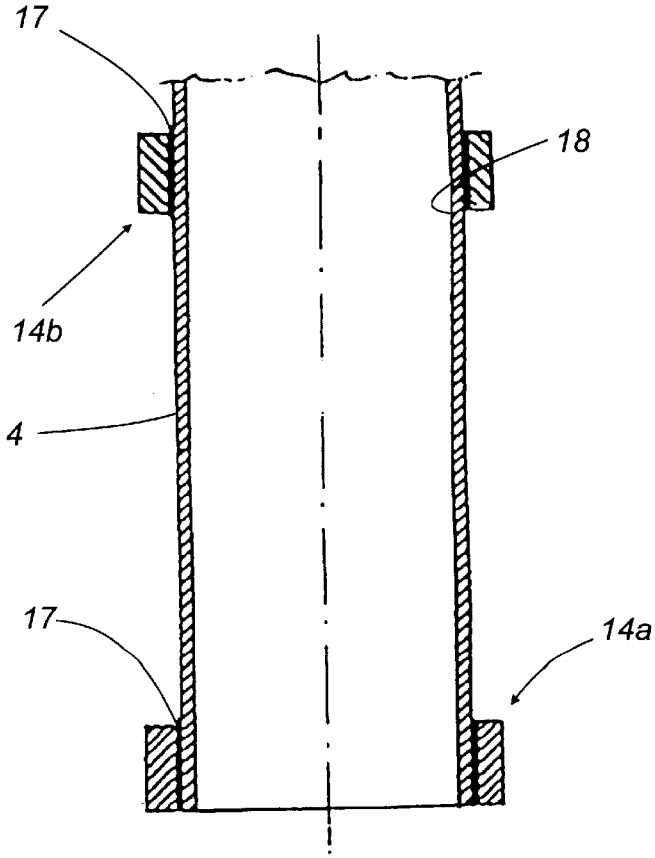
FIG. 5 is an elevation view sectioned according to the trace plane V—V of FIGS. 1 and 4.

In the invention, in regard to the barrel, the two supports 14*a*, 14*b* bearing the shoes 16 are constituted by separate steel pieces (possibly obtained by casting) whose shoe seats are machine before coupling to the barrel; the coupling of these two pieces to the barrel is accomplished by means of a casting of appropriate hardening plastic material between the barrel and the two shoe-bearing supports in such a way as to fill and jam the gap that was conveniently provided between the two pieces (see FIG. 5) and consequently mutually secure the three pieces; obviously, the barrel and the two shoe-bearing supports are kept in their proper mutual position during the casting operation and subsequent solidification by means of appropriate equipment.

After this simple and rapid operation, the barrel is finished and ready to be coupled to the guide.

It should be noted that the mechanical machining of the shoe seats in this case is performed on two pieces of small dimensions and weight and therefore a machine tool of small size can be used, to the advantage of positioning and working times.

A variation that leads to a further constructive simplification and cost reduction, as well as to a reduction of the weight, can be that of making the barrel of fibreglass reinforced resin or other composite material instead of steel.

In this case, inside the barrel 4 can be inserted two steel path ways 4*a* (see FIG. 4) which can serve for the vertical sliding of the shoes of a second barrel (telescoping solution); these path ways are finished by a machine tool before being incorporated in the composite material and will be kept in position, during the layering operation, by means of appropriate equipment.

In this case the procedure described above for the coupling between barrel and shoe-bearing supports 14*a, b* (also made of steel) is the most appropriate, effective and low cost; any other conceivable solution for fastening these three pieces would be very complex, costly and poorly reliably given the considerable diversity of the materials of the barrel and of the shoe-bearing supports.

In the practical construction of the various parts of the invention, several variations can be introduced, without thereby departing from the scope of protection of the present invention, as defined in the claims that follow.

Moreover, all details may be replaced with technical equivalent ones.

In practice the materials employed, as well as the forms and dimensions, may be any depending on requirements, without thereby departing from the scope of protection of the claims that follow.

What is claimed is:

1. Mechanism (1) for the vertical translation of tubular structures for underwater vessels of the type constituted by a rectilinear guide (2) with closed section which is fastened vertically in the sail (3) of the underwater vessel, by a barrel (4) translating vertically inside said guide and bearing a sensor (5) at its upper end, and by a device (6) for the vertical actuation of said barrel; said guide (2) being constituted by a flattened upright (7) which along the flanks has integral therewith two sliding ways (9) opened towards each other and it has its edges secured by a rugged and simple stiffening element (13) constituted by a "U" shaped structure; said barrel (4) in proximity to the lower end being provided with two supports (14*a*), (14*b*) which bear shoes (16) for sliding along said ways, said barrel being secured to said supports (14*a*), (14*b*) by the casting of an appropriate hardening plastic material (17).

2. A mechanism as claimed in claim 1 wherein said upright is constituted by two section bars (8*a*), (8*b*) which along the edges have "U" shaped portions (9) able to define said sliding ways, said section bars (8*a*), (8*b*) being mutually joined by means of a welded structure (10).

3. A mechanism as claimed in claim 1, wherein the flanks of said upright (7) are connected to the respective edges (12) of said stiffening elements (13) with a plurality of screws (19) or (20).

4. A mechanism as claimed in claim 1, wherein the flanks of said upright 7 are connected to the respective edges of said stiffening element (13) by welding (21).

5. A mechanism as claimed in claim 1, wherein said stiffening element (13) is constituted by a metal plate bent into a "U" shape.

6. A mechanism as claimed in claim 1, wherein said stiffening element (13) is constituted by three metal plates (13*a*, 13*b*, 13*c*) arranged in a "U" shape and welded to each other.

7. A mechanism as claimed in claim 1, wherein said stiffening element (13) is made of a material of the type of fibreglass reinforced resin or other composite material.

8. A mechanism as claimed in claim 1, wherein said barrel (4) is made of a material of the type of fibreglass reinforced resin or other composite material.

9. A mechanism as claimed in claim 1, wherein said barrel (4) is made of a material of the type of steel.

10. A mechanism as claimed in claim 1, wherein said barrel (4), made of fibreglass reinforced resin or other composite material has, incorporated within it, two symmetrically opposite path ways (4*a*) made of steel for the sliding of the shoes of a second barrel (telescoping solution).

* * * * *